US007736418B2

(12) United States Patent
Graβ

(10) Patent No.: US 7,736,418 B2
(45) Date of Patent: Jun. 15, 2010

(54) CONTROL DEVICE AND CONTROL METHOD FOR AN ELECTROSTATIC FILTER WITH A CONFIGURABLE NUMBER OF PARALLEL AND SERIAL FILTER ZONES

(75) Inventor: Norbert Graβ, Herzogenaurach (DE)

(73) Assignee: Siemens Aktiengesellschaft, Munich (DE)

( * ) Notice: Subject to any disclaimer, the term of this patent is extended or adjusted under 35 U.S.C. 154(b) by 679 days.

(21) Appl. No.: 11/658,530

(22) PCT Filed: Jul. 21, 2005

(86) PCT No.: PCT/EP2005/053557

§ 371 (c)(1),
(2), (4) Date: Jan. 25, 2007

(87) PCT Pub. No.: WO2006/010738

PCT Pub. Date: Feb. 2, 2006

(65) Prior Publication Data

US 2009/0260520 A1 Oct. 22, 2009

(30) Foreign Application Priority Data

Jul. 26, 2004 (DE) ..... 10 2004 036 210

(51) Int. Cl.
*B03C 3/68* (2006.01)

(52) U.S. Cl. ..... 95/2; 95/6; 95/7; 96/18; 96/22; 96/24; 96/25; 96/26; 96/80; 323/903; 700/273

(58) Field of Classification Search ..... 95/2–7; 96/18–26, 73, 80–82; 700/2, 17, 19, 273, 700/276, 277; 323/903

See application file for complete search history.

(56) References Cited

U.S. PATENT DOCUMENTS

| | | | | |
|---|---|---|---|---|
| 3,893,828 | A * | 7/1975 | Archer | 96/19 |
| 4,008,057 | A * | 2/1977 | Gelfand et al. | 96/25 |
| 4,354,860 | A * | 10/1982 | Herklotz et al. | 95/6 |
| 4,432,062 | A * | 2/1984 | Herklotz et al. | 95/26 |
| 4,860,149 | A * | 8/1989 | Johnston | 361/79 |
| 5,114,442 | A * | 5/1992 | Artz | 96/19 |
| 5,471,377 | A * | 11/1995 | Donig et al. | 95/5 |
| 6,040,777 | A * | 3/2000 | Ammann et al. | 340/632 |
| 6,189,109 | B1 | 2/2001 | Sheikh et al. | |
| 6,282,106 | B2 * | 8/2001 | Grass | 363/37 |
| 6,370,448 | B1 | 4/2002 | Eryurek | |
| 7,156,897 | B2 * | 1/2007 | Wen | 95/28 |
| 7,366,369 | B2 * | 4/2008 | Grass | 385/24 |

(Continued)

FOREIGN PATENT DOCUMENTS

DE 102 14 185 A1 10/2003

(Continued)

*Primary Examiner*—Richard L Chiesa

(57) ABSTRACT

The aim of the invention is to be able to adapt an item of visualization or optimization software with the least possible amount of effort made on any electrostatic filter configurations. To this end, the invention provides that the electrostatic filter, the high-voltage supply units, and the auxiliary functional units can be used by the software modules in the server component as objects with characteristic features and with characteristic methods, that are capable of being accessed as information, which only exists in the server component, for the client modules via data interfaces.

17 Claims, 2 Drawing Sheets

U.S. PATENT DOCUMENTS

| | | | | |
|---|---|---|---|---|
| 7,502,701 | B2 * | 3/2009 | Grass | 702/64 |
| 2001/0006469 | A1 * | 7/2001 | Grass | 363/37 |
| 2001/0029728 | A1 * | 10/2001 | Massey et al. | 55/471 |
| 2003/0010203 | A1 * | 1/2003 | Farmer et al. | 95/2 |
| 2004/0098173 | A1 * | 5/2004 | Grass | 700/297 |
| 2005/0119862 | A1 * | 6/2005 | Grass | 702/188 |
| 2006/0153519 | A1 * | 7/2006 | Grass | 385/147 |

FOREIGN PATENT DOCUMENTS

| | | | | |
|---|---|---|---|---|
| EP | 569815 | A1 * | 11/1993 | 96/23 |
| EP | 569838 | A1 * | 11/1993 | 95/6 |
| WO | WO 99/60487 | A1 | 11/1999 | |
| WO | WO 03/083731 | A2 | 10/2003 | |

* cited by examiner

CONTROL DEVICE AND CONTROL METHOD FOR AN ELECTROSTATIC FILTER WITH A CONFIGURABLE NUMBER OF PARALLEL AND SERIAL FILTER ZONES

CROSS REFERENCE TO RELATED APPLICATIONS

This application is the U.S. National Stage of International Application No. PCT/EP2005/053557, filed Jul. 21, 2005 and claims the benefit thereof. The International Application claims the benefits of German application No. 10 2004 036 210.6 filed Jul. 26, 2004, both of the applications are incorporated by reference herein in their entirety.

FIELD OF INVENTION

The invention relates to a control entity for electrostatic precipitators including a configurable number of parallel and serial precipitator zones, each of which is assigned a high-voltage supply unit and auxiliary functional units, wherein said control entity features a server component and client modules and wherein different server modules are implemented in said control entity, said server modules allowing access to data of the electrostatic precipitator, the high-voltage supply units and the auxiliary functional units in order that said data can be visually displayed, stored and/or used as a basis for optimizing the electrostatic precipitator operation, and to a corresponding control method for electrostatic precipitators.

BACKGROUND OF THE INVENTION

In known control entities and/or control methods of this type for electrostatic precipitators, a server program communicates with the high-voltage supply units and auxiliary functional units and provides cyclical and event-driven communication for the client modules of the control entity. The corresponding data which is received in the client modules is assigned to the electrostatic precipitators, visually displayed or used for optimization there, i.e. in the client modules. Using this approach, the assignment or classification of the received data to the electrostatic precipitators must be managed by each client module itself. If there is a plurality of electrostatic precipitators, the complexity of these management tasks increases drastically. The checking effort involved in verification of the functionality of the software increases significantly, since it is not possible using justifiable effort to check all conceivable configurations. The computing effort also increases since specific data, e.g. the total electrical power, has to be calculated in a plurality of client modules, e.g. in the client modules which are used for visual display and optimization. Furthermore, the quantity of data which must be transmitted over the connection between the server component and the client modules is comparatively high.

SUMMARY OF INVENTION

Taking as its point of departure the prior art described above, the invention addresses the problem of providing a control entity and a control method for electrostatic precipitators, which control entity and control method can be adapted to any configuration of electrostatic precipitators with comparatively little effort in terms of its visual display and optimization software, and in which control entity and control method the overall effort that must be expended for the control is reduced in comparison with the prior art.

This problem is solved by means of a control entity for electrostatic precipitators in which the electrostatic precipitator, the high-voltage supply units and the auxiliary functional units can be set up in the server component, by means of the software modules, as objects having characteristic properties and characteristic methods, wherein said objects can be accessed by the client modules via data interfaces as information which is present solely in the server component. It is common to the different software modules that the electrostatic precipitator can be considered as an object having properties, e.g. emission, and methods, e.g. power calculation. The electrostatic precipitator consists of a number of similar objects, specifically high-voltage supply units and auxiliary functional units. The spatial arrangement of each precipitator zone in the electrostatic precipitator is significant for both the visual display and the optimization. The arrangement of each precipitator zone can therefore be represented in terms of a property of the electrostatic precipitator object. Physical properties of the electrostatic precipitator, the high-voltage supply units and/or the auxiliary functional units are reproduced in the software by means of the cited properties of the different software modules.

Auxiliary functional units of the electrostatic precipitators might include discharge wire rappers and/or insulator heaters and/or purge air fans and/or purge air heaters and/or high-voltage rectifiers and/or collecting plate rappers and/or gas distribution rappers and/or dust hopper heaters and/or dust hopper fill-level indicators and/or dust extractors.

Characteristic properties of the object "electrostatic precipitator" which is present on the server component might include the name or the identification of the electrostatic precipitator and/or the number of parallel and serial precipitator zones of the electrostatic precipitator and the position of these in the electrostatic precipitator and/or the assignment of the high-voltage supply units to the precipitator zones and/or planned and actual emission values of the electrostatic precipitator and/or the assignment of the planned and actual emission values to precipitator zones of the electrostatic precipitator and/or process values, e.g. temperature and flow volume, of the electrostatic precipitator and/or a current optimization mode of the electrostatic precipitator and/or the current operating mode, e.g. start-up or optimization of energy consumption.

Characteristic methods of the object "electrostatic precipitator" which is present on the server component might include its total electrical power and/or partial electrical powers of its serial and parallel precipitator zones, said methods being calculated or determined in the object "electrostatic precipitator".

Characteristic properties of the objects "high-voltage supply units" which are present on the server component might include the name or the identification of the respective high-voltage supply unit and/or planned and actual values for voltage, current and power at the respective high-voltage supply unit and/or status reports of the respective high-voltage supply unit and/or error reports of the respective high-voltage supply unit and/or process signals and their scaling, e.g. into 0 to 20 mA signals, which are specified at the control entity, and/or the operating parameters which are set at the respective high-voltage supply unit.

Characteristic methods of the objects "high-voltage supply units" which are present on the server component might include average power values over defined time periods and/or switching actions, possibly with remote indication, and/or error acknowledgements and/or process values, e.g. temperature in degrees Celsius, and/or the setting of planned values and/or the selection of operating modes, e.g. optimization, oscilloscope start-up, or recording the U/I characteristic curve, said methods being calculated or determined in the respective object "high-voltage supply unit".

Individual objects which are derived from the objects of the "electrostatic precipitator" and/or "high-voltage supply unit" and/or "auxiliary functional unit" class are advantageously created by means of the client modules.

For the purposes of the invention, classes can also be defined using optimization programs of the client modules, wherein one or more precipitator zones of the electrostatic precipitator can be represented by means of said classes. Using the above described control entity and/or the corresponding control method for electrostatic precipitators, it is possible to achieve a significant improvement in performance compared with the prior art by means of more effective data transmission between the individual parts of the control device. The standard class definitions which are present in the server component are available for all client modules of the control entity. This results in a significant reduction in resource requirements. Expansion of the class definitions is simplified because changes need only be made in the field of the server component, thereby achieving a significant reduction in development time. The server component functions as a virtual software platform, whereas the client modules contain the "intelligence". A lower susceptibility to software error is achieved by virtue of more rigorous data encapsulation, thereby resulting in higher software quality. According to the invention, it is particularly easy to realize the optimization of a plurality of electrostatic precipitators by means of one or more of the client modules used for optimization.

BRIEF DESCRIPTION OF THE DRAWINGS

The invention is explained in greater detail below with reference to an embodiment and with reference to the drawing, in which.

DETAILED DESCRIPTION OF INVENTION

Figure 1:
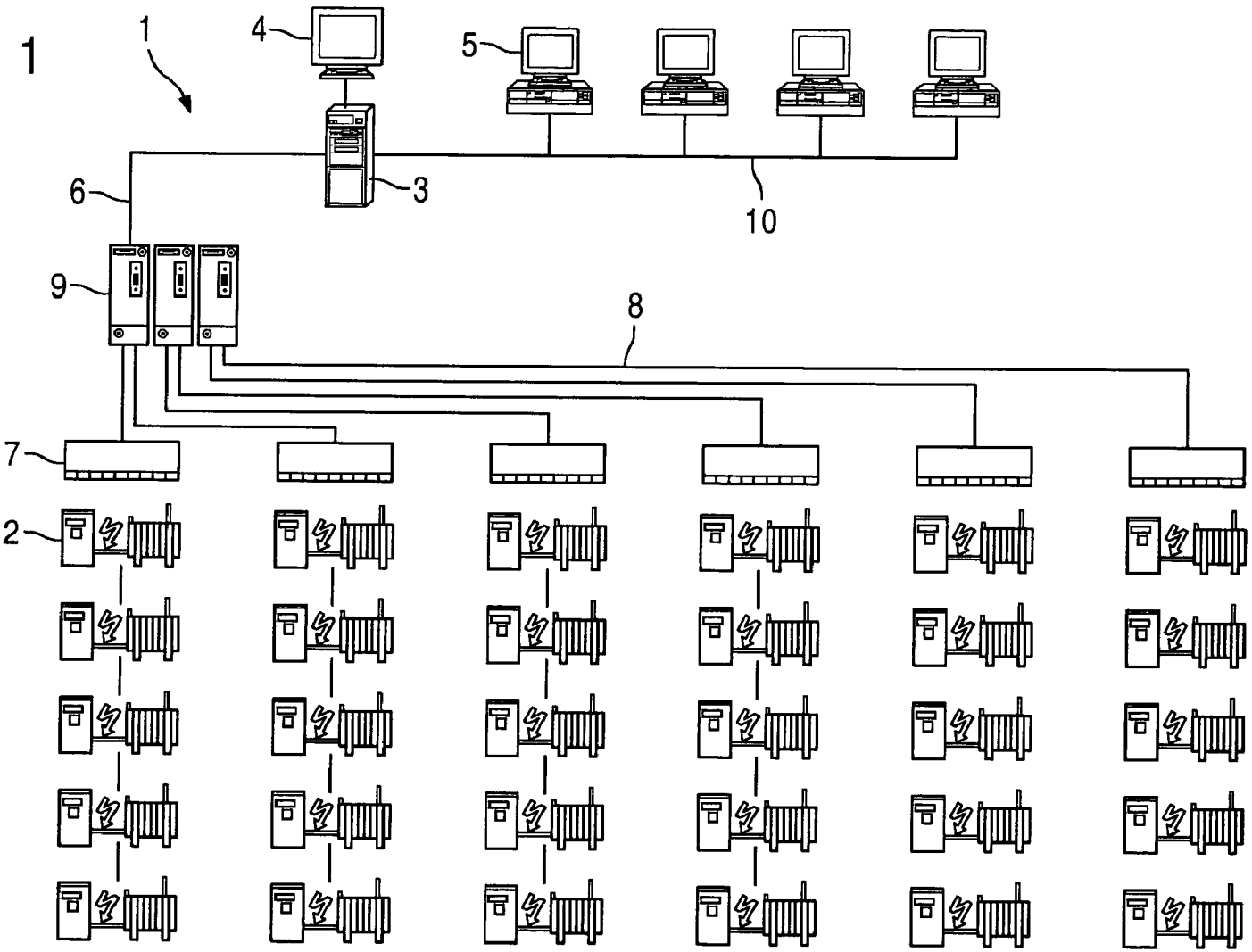
FIG. 1 shows an embodiment of a control entity for electrostatic precipitators in accordance with the invention.

FIG. 1 shows an embodiment of a control entity 1 for electrostatic precipitators including a configurable number of parallel and serial precipitator zones, each of which is assigned a high-voltage supply unit 2 and auxiliary functional units (not shown in the figure), said control entity having a server component 3 with a monitor 4 and—in the illustrated exemplary embodiment—four client modules 5.

The server component 3 is connected to the high-voltage supply units 2 via a Profibus network 6. For this, a bus coupler 7 is assigned in each case to a group of—in the illustrated exemplary embodiment—five high-voltage supply units 2 with controllers. The—in the illustrated exemplary embodiment—six bus couplers 7 are connected via an optical Profibus 8 to optical interface modules 9, which in turn are connected to the server component 3.

The server component 3 with the—in the illustrated exemplary embodiment—four client modules 5 forms a second network 10 which is designed as e.g. an Ethernet network using the TCP/IP protocol. Alternatively, customary standard networks can also be used as a second network 10.

Various software modules are implemented in the control entity 1. Using these software modules, it is possible to access data relating to the electrostatic precipitator as a whole, the high-voltage supply units 2 and the auxiliary functional units. This accessible data can be visually displayed, stored and used as a basis for optimizing the operation of the electrostatic precipitator.

Figure 2:
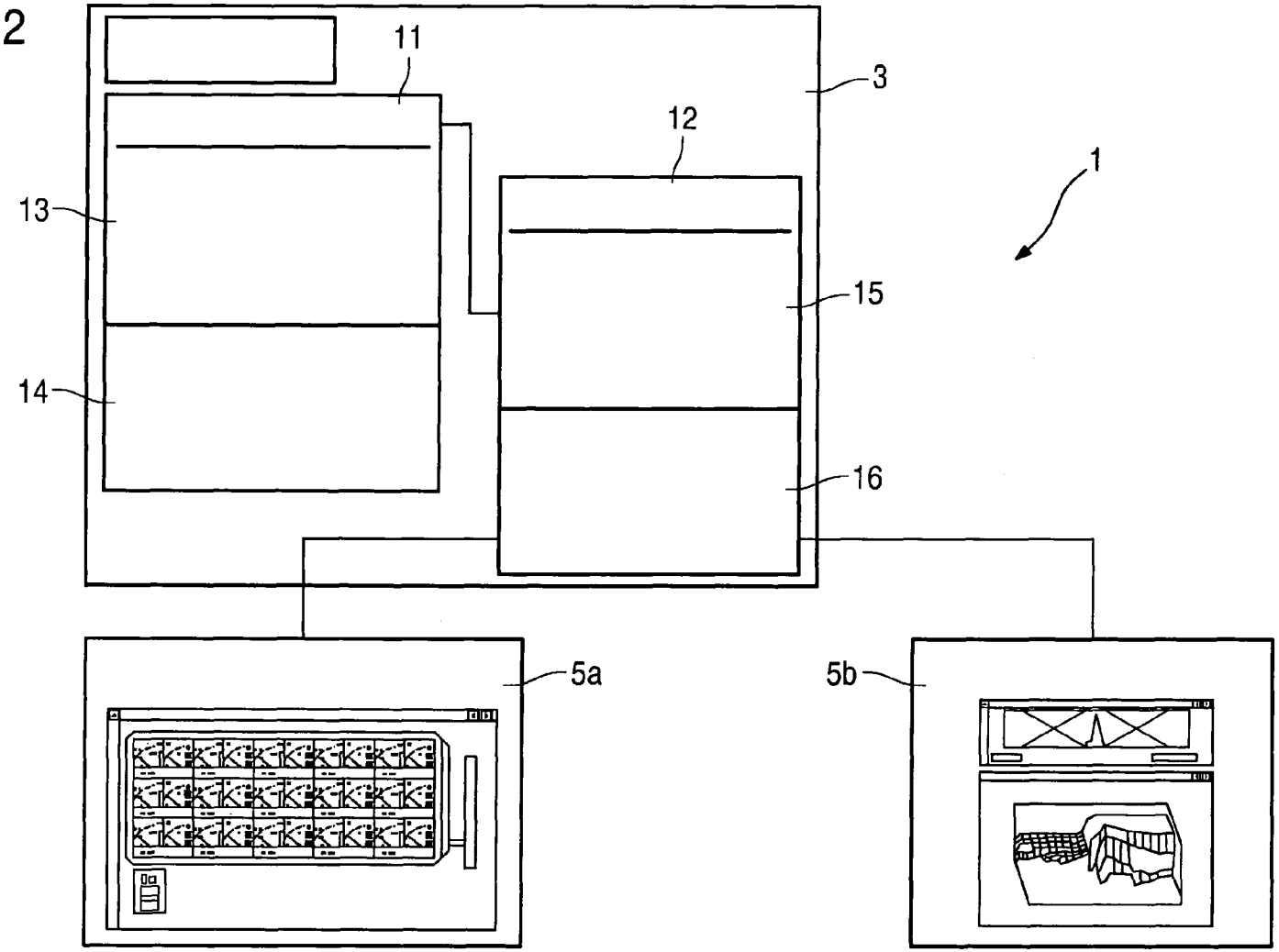
FIG. 2 shows a schematic representation of a server component and two client modules of the control entity for electrostatic precipitators as shown in FIG. 1.

For this, the electrostatic precipitator, or electrostatic precipitators if the control entity 1 is to supply a plurality of electrostatic precipitators, the high-voltage supply units 2 and the auxiliary functional units are set up as objects 11, 12 in the server component 3 by means of the software modules, as shown in FIG. 2 for the object "high-voltage supply unit" 11 and the object "electrostatic precipitator" 12.

The objects 11, 12, which are present solely in the server component 3 of the control entity 1, can be accessed by the client modules 5, of which one client module **5*a* that is used for visual display and one client module 5*b* that is used for optimization purposes are shown in FIG. 2**, via data interfaces having suitable access and protection mechanisms.

The object "high-voltage supply unit" 11 is organized into a first area 13 and a second area 14, wherein the characteristic properties of the respective high-voltage supply unit 2 are represented in the first area 13 of the object "high-voltage supply unit" 11. Characteristic properties include the name or the identification of the respective high-voltage supply unit 2, the planned and actual values for voltage, current and power at the respective high-voltage supply unit 2, the status reports of the respective high-voltage supply unit 2, error reports of the respective high-voltage supply unit 2, process signals and their scaling, e.g. into 0 to 20 mA signals which are specified at the control entity 1, and/or all operating parameters which are set at the respective high-voltage supply unit 2.

The second area 14 of the object "high-voltage supply unit" 11 which is present in the server component 3 is used to represent characteristic methods which are calculated or determined in the object 11 itself, such as average power values over defined time periods, switching actions, possibly with remote indication, error acknowledgements, process values, e.g. temperature in degrees Celsius, the setting of planned values and/or the selection of operating modes, e.g. optimization, oscilloscope start-up, or recording the U/I characteristic curve.

Correspondingly, the object "electrostatic precipitator" 12, which is present solely in the server component 3, is organized into a first area 15 and a second area 16, wherein the first area 15 of the object "electrostatic precipitator" 12 can include characteristic properties of the electrostatic precipitator such as name or identification, number of parallel and serial precipitator zones of the electrostatic precipitator and position of these in the electrostatic precipitator, assignment of the high-voltage supply units 2 to the precipitator zones, planned and actual emission values of the electrostatic precipitator, assignment of planned and actual emission values to precipitator zones of the electrostatic precipitator, process values, e.g. temperature and flow volume, a current optimization mode of the electrostatic precipitator and/or the current operating mode, e.g. start-up or optimization of energy consumption.

In the second area 16 of the object "electrostatic precipitator" 12, the total power of the electrostatic precipitator and/or partial powers of its serial and parallel precipitator zones are represented as characteristic methods which are calculated or determined in the object "electrostatic precipitator" 12.

Since the objects 11, 12 are set up solely in the server component 3 and are available to all client modules 5, the latter do not require any storage facilities for the objects 11, 12; instead the client modules 5 merely have data interfaces for accessing the objects 11, 12 or information, said objects or information being present solely in the server component 3.

The client modules 5 can also create further individual objects, wherein these can be derived from the classes of the objects "high-voltage supply units" 11 or the objects "electrostatic precipitators" 12; alternatively the client modules 5 can access the specified objects 11, 12 or data relating to the same. Optimization programs, for example, can therefore define individual classes which then represent partial areas of the electrostatic precipitator, said partial areas comprising a plurality of precipitator zones of the electrostatic precipitator.

In addition to the above specified objects 11, 12 for high-voltage supply units 2 and electrostatic precipitators respectively, objects—not illustrated in the figures—corresponding to the auxiliary functional units of the electrostatic precipitator can be set up in the server component 3, e.g. objects for discharge wire rappers, insulator heaters, purge air fans, purge air heaters, high-voltage rectifiers, collecting plate rappers, gas distribution rappers, dust hopper heaters, dust hopper fill-level indicators and/or dust extractors of the electrostatic precipitator. These objects can also be divided into areas having characteristic properties and characteristic methods.

The invention claimed is:

1. An electrostatic precipitator, comprising:

a plurality of configurable parallel and serial precipitator zones;

a plurality of high-voltage supply units each assigned to one of the plurality of zones;

a plurality of auxiliary functional units each assigned to one of the plurality of zones; and a control entity having a server component and a client module, the control entity incorporating different software modules allowing access to data of the electrostatic precipitator, the high-voltage supply units, and the auxiliary functional units so data can be visually displayed, stored or used as a basis for optimizing the electrostatic precipitator operation, wherein the electrostatic precipitator, the high-voltage supply units and the auxiliary functional units are set-up via the server component of the control entity, by the software modules, as objects having characteristic properties and characteristic methods, where the objects are accessible by the client modules via data interfaces as information present only in the server component.

2. The electrostatic precipitator as claimed in claim 1, wherein the auxiliary functional units are selected from the group consisting of: discharge wire rappers, insulator heaters, purge air fans, purge air heaters, high-voltage rectifiers, collecting plate rappers, dust hopper heaters, dust hopper fill-level indicators, dust extractors and combinations thereof.

3. The electrostatic precipitator as claimed in claim 2, wherein characteristic properties of the electrostatic precipitator object present on the server component comprises:

a name or an identification of the electrostatic precipitator, and/or a number relating to the zones of the electrostatic precipitator, and a position relating to the zones in the electrostatic precipitator, and/or an assignment of the high-voltage supply units to the precipitator zones, and/or a planned emission value of the electrostatic precipitator, and an actual emission value of the electrostatic precipitator, and/or an assignment of the planned and actual emission values to precipitator zones of the electrostatic precipitator, and/or process values of the electrostatic precipitator, and/or a current optimization mode of the electrostatic precipitator, and/or a current operating mode.

4. The electrostatic precipitator as claimed in the claim 3, wherein characteristic methods of the electrostatic precipitator object present on the server component are determined in the electrostatic precipitator object present on the server component and comprise a total electrical power or a partial electrical powers of the serial and parallel precipitator zones.

5. The electrostatic precipitator as claimed in claim 2, wherein characteristic properties of the high-voltage supply units objects present on the server component comprise:

a name or the identification of the respective high-voltage supply unit, and/or a planned value for voltage, a current and a power at the respective high-voltage supply unit, and an actual value for voltage, the current and the power at the respective high-voltage supply unit, and a status report of the respective high-voltage supply units, and/or an error report of the respective high-voltage supply units, and/or process signals and associated scaling that are specified at the control entity, and/or an operating parameter set at the respective high-voltage supply unit.

6. The electrostatic precipitator as claimed in claim 5, wherein the process signals are 0 to 20 mA signals.

7. The electrostatic precipitator as claimed in claim 5, wherein the characteristic methods of the high-voltage supply unit objects present on the server component are determined in the respective high-voltage supply unit object and comprise:

average power values over defined time periods, and/or switching actions with a remote indication, and/or error acknowledgements, and/or process temperature values in degrees Celsius, and/or the setting of planned values and/or the selection of operating modes, wherein the operating modes are selected from the group consisting of: optimization, oscilloscope start-up, and recording the U/I characteristic curve.

8. The electrostatic precipitator as claimed in claim 7, wherein individual objects derived from the electrostatic precipitator objects or high-voltage supply unit objects or auxiliary functional unit class are creatable by the client modules.

9. The electrostatic precipitator as claimed in claim 8, wherein classes are definable by optimization programs of the client modules, where one or more precipitator zones of the electrostatic precipitator are represented by the classes.

10. A control method for electrostatic precipitators, comprising:

configuring a plurality of parallel and serial precipitator zones;

assigning a high-voltage supply unit and an auxiliary functional unit to each of the plurality of parallel and serial precipitator zones; and accessing a data of the electrostatic precipitators, the high-voltage supply units and the auxiliary functional units by different software modules so the data can be visually displayed, stored or used as a basis for optimizing the electrostatic precipitator operation, wherein the electrostatic precipitator, the high-voltage supply units and the auxiliary functional units are set-up via only one server component of a control entity, by the software modules, as objects having characteristic properties and characteristic methods, and that client modules of the control entity access the objects, which have been set up solely in the server component, via data interfaces.

11. The control method as claimed in claim 10, wherein the auxiliary functional units are selected from the group consisting of: discharge wire rappers, insulator heaters, purge air fans, purge air heaters, high-voltage rectifiers, collecting plate rappers, gas distribution hoppers, dust hopper heaters, dust hopper fill-level indicators and dust extractors of the electrostatic precipitators.

12. The control method as claimed in claim 11, wherein characteristic properties of the electrostatic precipitator object present on the server component comprise:

a name or an identification of the electrostatic precipitator, and/or a number relating to the zones of the electrostatic precipitator and a position relating to the zones in the electrostatic precipitator, and/or the assignment of the high-voltage supply units to the precipitator zones, and/or planned and actual emission values of the electrostatic precipitator, and/or an assignment of the planned and actual emission values to the precipitator zone of the electrostatic precipitator, and/or process temperature and flow volume values of the electrostatic precipitator, and/or a current optimization mode of the electrostatic precipitator, and/or a current operating start-up or optimization of energy consumption mode.

13. The control method as claimed in claim 12, wherein characteristic methods of the electrostatic precipitator object present on the server component are determined in the electrostatic precipitator object present on the server component and comprise a total electrical power or a partial electrical powers of the serial and parallel precipitator zones.

14. The control method as claimed in claim 11, wherein characteristic properties of the high-voltage supply units objects present on the server component comprise:

a name or the identification of the respective high-voltage supply unit, and/or a planned value for a voltage, a current and a power at the respective high-voltage supply unit, and an actual value for the voltage, the current and the power at the respective high-voltage supply unit, and a status report of the respective high-voltage supply units, and/or an error report of the respective high-voltage supply units, and/or process signals and associated scaling between 0 to 20 mA signals that are specified at the control entity, and/or an operating parameter set at the respective high-voltage supply unit.

15. The control method as claimed in claim 14, wherein the characteristic methods of the high-voltage supply unit objects present on the server component are determined in the respective high-voltage supply unit object and comprise:

average power values over defined time periods, and/or switching actions with remote indication, and/or error acknowledgements, and/or process temperature values in degrees Celsius, and/or the setting of planned values and/or the selection of operating modes, wherein the operating modes are selected from the group consisting of: optimization, oscilloscope start-up, and recording the U/I characteristic curve.

16. The control method as claimed in claim 15, wherein individual objects derived from the electrostatic precipitator objects or high-voltage supply unit objects or auxiliary functional unit class are creatable by the client modules.

17. The control method as claimed in claim 16, wherein classes are definable by optimization programs of the client modules, where one or more precipitator zones of the electrostatic precipitator are represented by the classes.

* * * * *